US007857316B2

(12) United States Patent
Shoemaker, Jr.

(10) Patent No.: US 7,857,316 B2
(45) Date of Patent: Dec. 28, 2010

(54) PROJECTILE ROULETTE ARCADE GAME

(76) Inventor: Stephen P. Shoemaker, Jr., 531 N. Francisca Ave., Redondo Beach, CA (US) 90277

( * ) Notice: Subject to any disclaimer, the term of this patent is extended or adjusted under 35 U.S.C. 154(b) by 901 days.

(21) Appl. No.: 11/801,666

(22) Filed: May 10, 2007

(65) Prior Publication Data

US 2008/0280661 A1 Nov. 13, 2008

(51) Int. Cl.
*A63F 7/06* (2006.01)

(52) U.S. Cl. ..... 273/317

(58) Field of Classification Search ..... 273/126 R, 273/342, 349, 317, 404; 463/59; 473/435, 473/472; 472/128; 345/440
See application file for complete search history.

(56) References Cited

U.S. PATENT DOCUMENTS

| | | | | |
|---|---|---|---|---|
| 5,044,639 | A * | 9/1991 | Egging et al. | 273/342 |
| 5,855,372 | A * | 1/1999 | Thiemann | 273/349 |
| 6,450,889 | B1 * | 9/2002 | Mendes, Jr. | 463/59 |
| 6,695,698 | B1 * | 2/2004 | Anghelo et al. | 463/25 |
| 6,843,478 | B1 * | 1/2005 | Hoepelman | 273/342 |
| 7,111,846 | B1 * | 9/2006 | Breslow et al. | 273/342 |
| 7,207,564 | B2 * | 4/2007 | Bedford et al. | 273/317 |
| 2003/0030218 | A1 * | 2/2003 | Zucchi et al. | 273/371 |
| 2009/0005147 | A1 * | 1/2009 | Okuaki et al. | 463/16 |
| 2009/0061979 | A1 * | 3/2009 | Okuaki et al. | 463/16 |
| 2010/0044960 | A1 * | 2/2010 | Nagayama et al. | 273/138.3 |

* cited by examiner

*Primary Examiner*—David L. Lewis
*Assistant Examiner*—Masud Ahmed
(74) *Attorney, Agent, or Firm*—Fulwider Patton LLP

(57) ABSTRACT

An arcade game is disclosed wherein a player actuates a projectile delivery system such as an air stream created by depressing a pump or bellows to cause a projectile such as a ball to be propelled over a rotating playing field. In a first preferred embodiment the projectile is a ball, and the ball may preferably be aimed by pointing the nozzle delivering an air stream aimable in varying azimuthal and altitudal directions. A point multiplier system is incorporated wherein said ball may pass through one of several arrayed apertures of varying size and difficulty within a housing that encloses the rotating playing field. A sensor detects the passage of a ball through an aperture and sends a signal to a processor to multiply the player's points by a predetermined amount. Whether the ball passes through an aperture or rebounds off the wall, the ball enters the rotating playing field where holes are disposed about the perimeter like a roulette wheel. The rotation of the playing field causes the ball to move outward via centrifugal force to the holes, where each hole is assigned a point value. When the ball enters a hole, a sensor sends a signal to a processor corresponding to a predetermined point value. The processor receives the signal and determines the point value achieved, augmented by any multiplier accomplished in the first phase, and sends a signal to a ticket distribution mechanism to distribute redemption tickets corresponding to the point value earned by the player.

7 Claims, 4 Drawing Sheets

PROJECTILE ROULETTE ARCADE GAME

BACKGROUND OF THE INVENTION

The present invention relates generally to arcade style entertainment apparatus, and more particularly to a coin or token actuated amusement device where a controlled airstream or other projectile delivery system propels a ball or other projectile onto a rotating playing field. Before entering the rotating playing field, the projectile can pass through by a barrier such as a wall with holes therein to accomplish a first phase of the game relying on skill, whereupon the second phase of the game comprising the action of the ball on the rotating playing field is essentially a chance proposition.

Arcade games that measure a player's skill and luck are well known in the art. The present inventor is the named inventor of many popular games found in today's arcades. For example, U.S. Pat. No. 4,272,082, entitled "Coin Projecting Amusement Device," discloses an amusement wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory which is then unloaded to vend out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin. U.S. Pat. No. 4,822,045 is directed to an amusement device comprised of a pair of spaced apart elongate members defining a track, and a rolling member for rolling along that track under control of an operator. The elongate members are spaced a fixed distance apart at their first ends establishing the normal home position of the rolling member. The opposite, second ends of the elongate members are moveable relative to one another to adjust their spacing and to control the movement of the rolling member along the track. The operator controls the separation of the elongate member so that the rolling member can roll from its home position to the opposite end of the track without falling between the opening separating the elongate members.

U.S. Pat. No. 5,553,865 discloses a rotary arcade game including a turn table having a central aperture. Prizes are positioned on the surface of the turn table and moved by a pivoting arm member operated by the player. The player attempts to manipulate an arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turn table, and the player manipulates a vacuum pick up device linearly along a radial direction of the turn table to pick up prizes below. U.S. Pat. No. 6,139,429 discloses another crane game using a video screen for displaying images. A maneuverable sensor contacts the display screen to select prizes displayed thereon. U.S. Pat. No. 6,095,519 discloses an arcade game including a directing mechanism for aiming a game piece such as a token. U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

U.S. Pat. No. 6,991,230 discloses an amusement device in the form of an arcade game that comprises a rotating playing field arrayed with targets at the perimeter. Using a projectile such as a token or coin, the player drops the projectile into a chute in an attempt to knock down the targets on the rotating playing field. If the player knocks over a target with the projectile, the target is recognized by a detector and then returned to its original position for subsequent play.

U.S. Pat. No. 7,168,702 invented by the present inventor discloses an arcade type amusement device wherein a projectile such as a token is aimed at a target via a guidance mechanism such as an elongate chute. A deflector may be used to alter the path of the projectile, where the deflector is intermittently present along the trajectory of the projectile so as to require timing to engage the deflector. Upon a successful strike of the target, a ball is released down a helical track toward a rotating playing field interspersed with holes assigned various values. When a ball reaches the rotating playing field, it will rebound and roll until it falls within one of said holes, whereupon a point value is awarded based on the particular value of the hole. The player may receiver redemption tickets or points based on the point value awarded.

The foregoing illustrate arcade type games credited to the present inventor. The games are predominantly skill-based with an element of luck woven into the overall operation of the games. The present invention is the inventor's most recent creation in this line of arcade type games.

SUMMARY OF THE INVENTION

The present invention is an arcade game wherein a player actuates a projectile delivery system such as an air stream created by depressing a pump or bellows to cause a projectile such as a ball to be propelled over a rotating playing field. In a first preferred embodiment the projectile is a ball, and the ball may preferably be aimed by pointing the nozzle delivering an air stream aimable in varying azimuthal and altitudal directions. In another preferred embodiment, a point multiplier system is incorporated wherein said ball may pass through one of several arrayed apertures of varying size and difficulty within a housing that encloses the rotating playing field. A sensor detects the passage of a ball through an aperture and sends a signal to a processor to multiply the player's points by a predetermined amount. Whether the ball passes through an aperture or rebounds off the wall, the ball enters the rotating playing field where holes are disposed about the perimeter like a roulette wheel. The rotation of the playing field causes the ball to move outward via centrifugal force to the holes, where each hole is assigned a point value. When the ball enters a hole, a sensor sends a signal to a processor corresponding to a predetermined point value. The processor receives the signal and determines the point value achieved, augmented by any multiplier accomplished in the first phase, and sends a signal to a ticket distribution mechanism to distribute redemption tickets corresponding to the point value earned by the player.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
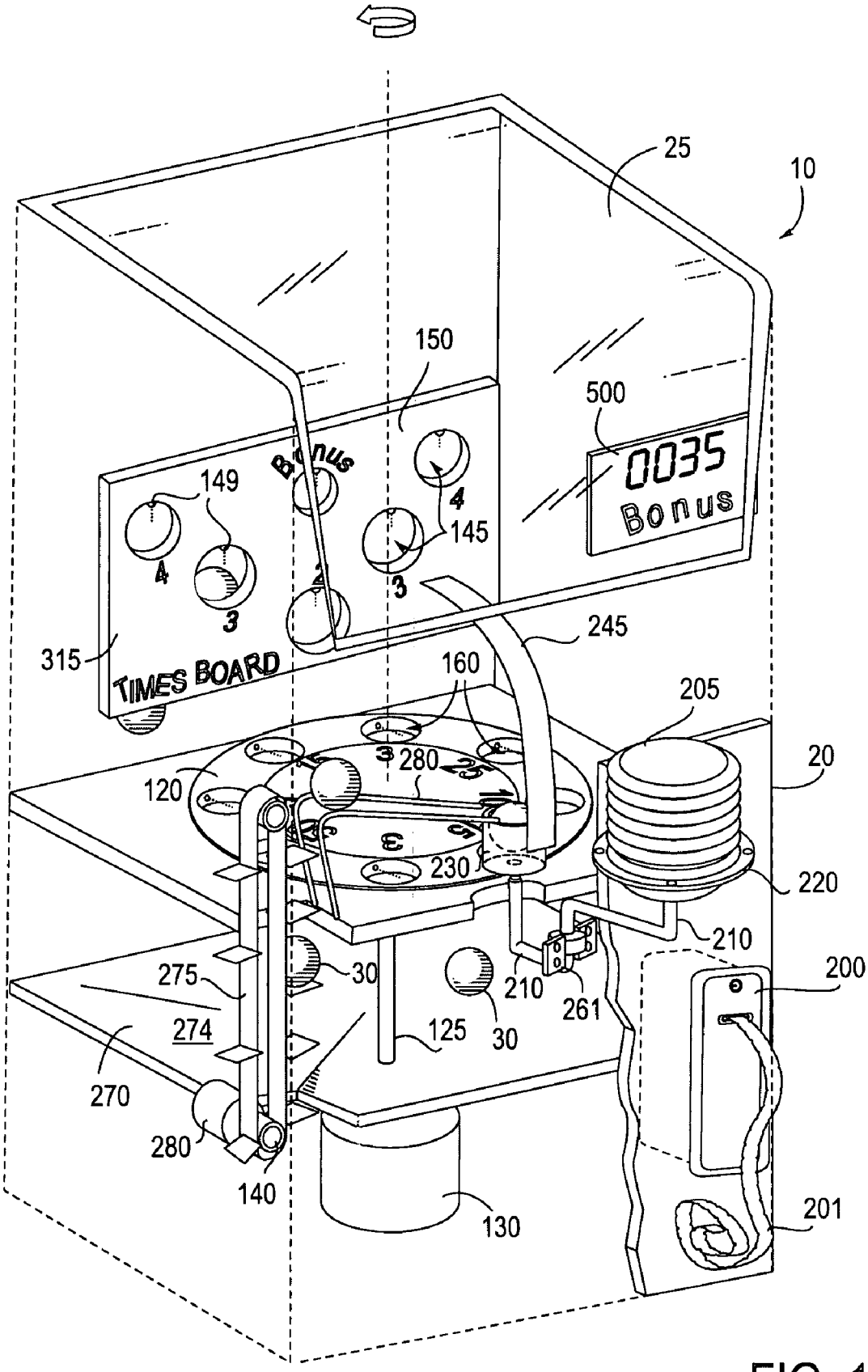
FIG. 1 is an elevated perspective view of a first preferred embodiment of the present invention.

For a better understanding of the present invention together with other and further objects, advantages and capabilities thereof, reference is made to the following disclosure and appended claims in connection with the above described drawings in connection with an arcade type amusement device. FIG. 1 depicts a first preferred embodiment of the present invention, namely an arcade game 10 having a housing 20 with a transparent Plexiglas window 25 for viewing the operation of the game. The game is preferably played with one or more balls 30 having some resiliency to enable bouncing of the ball on the rotating playing field, creating more anticipation and enjoyment of the game. A CPU 100 controls the operation of the game, including the ticket dispenser 200 for dispensing redemption tickets, the rotating playing field 120 mounted on a spindle 125 which in turn is driven by an electric motor 130, and a ball return mechanism 140. The CPU 100 is also coupled to openings 145 in a bonus multiplier board 150 and holes 160 in the rotating playing field 120 as explained more fully below.

Figure 2:
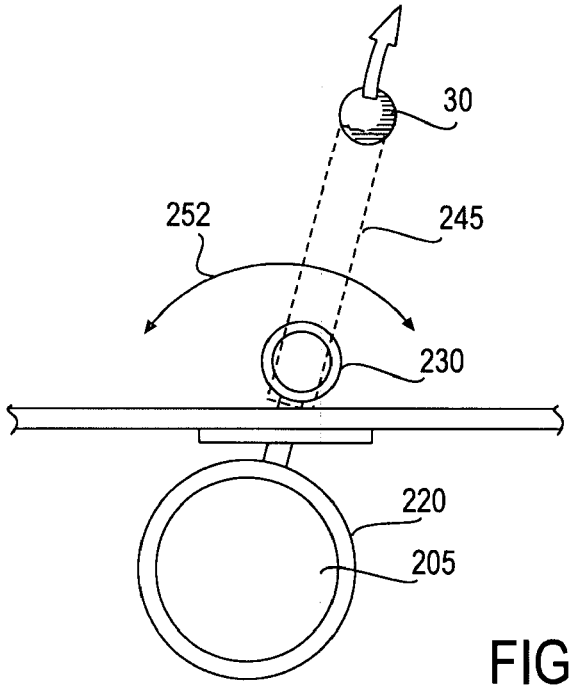
FIG. 2 is a top view, partially in shadow, of the air flow delivery system and aiming mechanism of the embodiment of FIG. 1.
Figure 3:
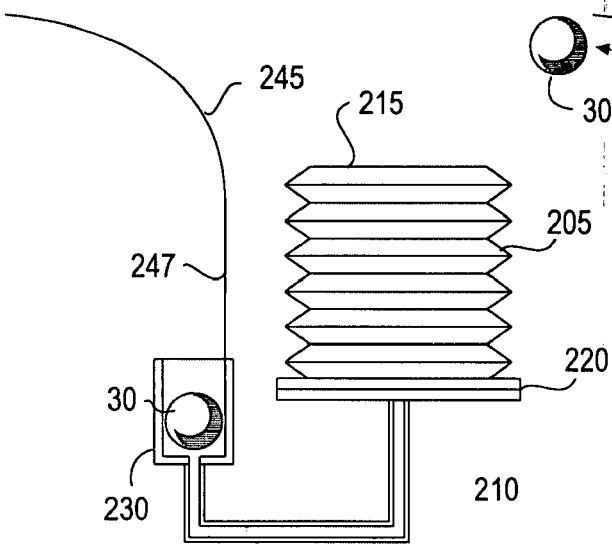
FIG. 3 is a schematic of a side view of the air flow delivery system and aiming mechanism of the embodiment of FIG. 1 prior to actuating the projectile.
Figure 4:
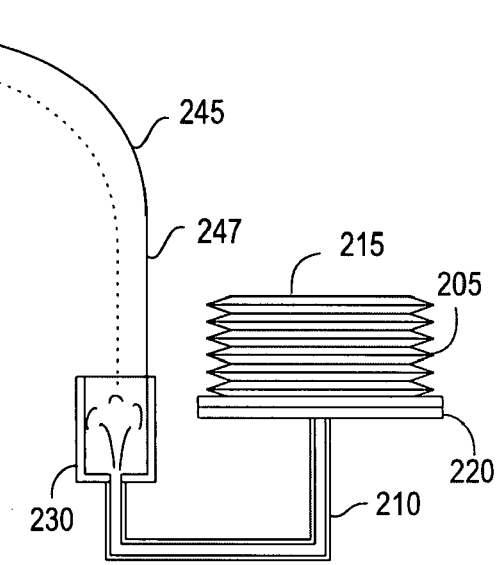
FIG. 4 is a schematic of a side view of the air flow delivery system and aiming mechanism of the embodiment of FIG. 1 immediately after actuating the projectile.

The arcade game 10 is preferably equipped with an air flow generating mechanism such as that shown in FIGS. 2-4. A collapsible bellows 205 is positioned outside of the housing 20 such that a player can rapidly expel air trapped in the expanded bellows 205 as by pressing or hitting down on the top side of the bellows 205 with the hand. The bellows 205 can be mounted on a platform 220, and the interior of the bellows is fluidly connected to a passageway 210 that leads to a launching cup 230. A curved guide 245 has a vertical bottom section gradually transitioning to a substantially horizontal portion 248 as shown particularly in FIGS. 3 and 4. The bellows 205, platform 220, passageway, and curved guide 245 can rotate as a fixed structure about a vertical axis indicated by arrows 252 in FIG. 2 looking down onto the air flow generating mechanism. As shown in FIGS. 3 and 4, when the bellows is in an uncompressed state it is full of air. When the player rapidly compresses the bellows by pressing or hitting the top end 215, the air formerly trapped in the bellows 205 is forced through the passageway 210 and into the launch cup 230. When a ball 30 is placed in the launch cup 230 by the ball return mechanism 140, the moving air introduced into the launch cup 230 via the passageway 210 propels the ball 30 out of the launch cup 230 on a vertical trajectory and is rerouted by the curved guide 245 to a horizontal trajectory as shown in FIG. 4. Thus, the player can first determine an azimuth component of the ball's trajectory by rotating the fixed structure about the vertical axis as shown in FIG. 2. Further, in a preferred embodiment the fixed structure can be rocked forward and backward about a pivot connection 260 that enables the altitude component of the ball's trajectory to be varied by the player. In this manner, the player can pre-select a desired azimuth and altitude for the trajectory of the ball 30 before initiating the launch action.

Returning to FIG. 1, a ball return mechanism 140 is shown for retrieving balls 30 from a lower platform 270 within the housing 20, where the platform 270 is slanted to collect the balls 30 in a pre-determined corner 274. A conveyor 275 driven by a motor 280 which is controlled by the CPU 100, such that balls entering the lower platform 270 are lifted by the conveyor 275 to a ramp 280, whereupon the balls 30 roll down the ramp and are deposited to the launch cup 230. This automated process allows the game to be played without access to the interior of the housing 20, as controlled by the CPU 100.

Figure 5:
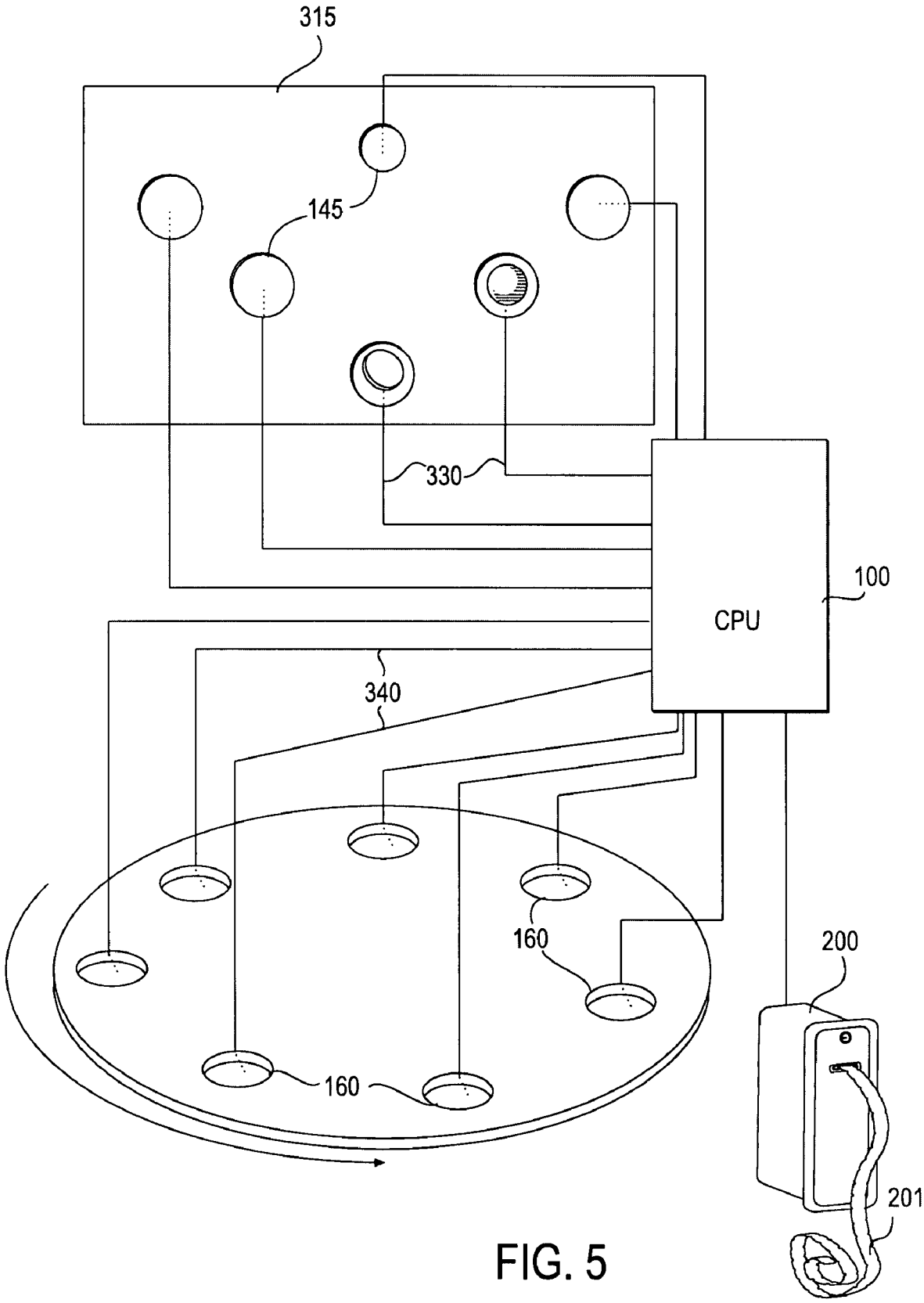
FIG. 5 is a schematic, perspective view of the CPU connected to both the bonus multiplier apertures and the scoring holes on the rotating playing field.

The arcade game 10 preferably includes a vertical target area such as the board 315 which includes a number of apertures 145 arranged on the board. Each aperture 145 may be assigned a multiplier value such as those shown in FIG. 1, e.g., "2," "3," and "4," etc. As shown in FIG. 5, each aperture 145 may be coupled to the CPU 100 via a sensor 149 for detecting the passage of a ball or other projectile, and a wire 330 for sending a signal from the sensors 149 to the CPU 100. In this manner, if a player can deliver a ball 30 or other projectile via the projectile launching mechanism into and through one of the apertures 145, the sensor detects that a projectile has successfully passed through an aperture and relays a signal to the CPU 100, along with information on either the identity of the aperture or the value of the multiplier. The CPU 100 stores the information for determining a player score or reward.

When the player launches the ball 30 at the vertical target area, whether it passes through an aperture 145 and achieves a multiplier or not, the ball falls onto the rotating playing field 120 below the vertical target area 150. The rotating playing field 120 is driven by the motor 130, and includes a plurality of holes 160 at the periphery of the playing field. Rotation of the field causes the balls 30 to travel outward due to centrifugal force to where the holes are positioned, causing the ball 30 to fall through one of the holes 160 to the lower platform 270. In passing through the holes 160, sensors 149 detect and relay the passage of the ball through the hole 160 via wires 340 as shown in FIG. 5 to the CPU. Each hole 160 may have associated therewith a point or ticket value, such that when the pass passes through the hole the CPU automatically detects the passage of the ball via the sensor and credits the player with a point value associated with the hole. Further, if the ball first passes through an aperture 145 corresponding to a multiplier or bonus value, the CPU recalculates the score to reflect the appropriate multiplier. The score or earned tickets can be displayed on a display 500 connected to the CPU. The CPU can then send a command to ticket dispenser 200 to dispense redemption tickets 201 which can be redeemed by the player for prizes, etc.

Figure 6:
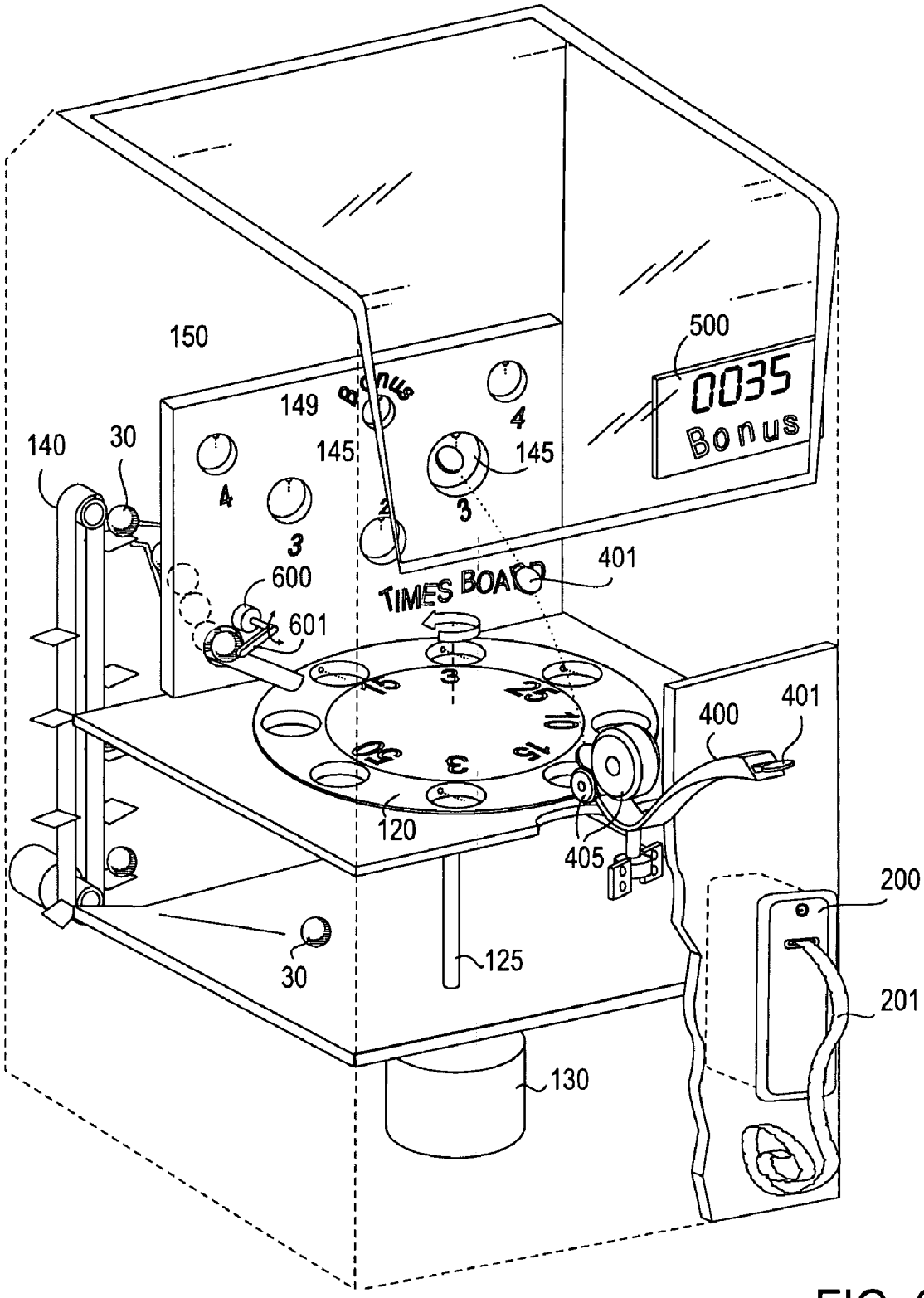
FIG. 6 is a second preferred embodiment of the present invention.

In a second preferred embodiment shown in FIG. 6, the skill portion of the game has the ball projectile replaced with a coin or token projectile 401 shot by passing the coin or token through a chute 400, where it passing between two rotating wheels 405 rotating in opposite directions. The token 401 must pass through one of the apertures 145 before a ball 30 is released by a lever 601 driven by a motor 600, which in turn is controlled by the CPU 100. The player thus attempts to aim the chute 400 toward an aperture 145 by rotating its azimuth direction and rocking its altitude orientation. A token 401 is placed in the chute 400 and it passes down the chute under the influence of gravity toward the rotating wheels 405, whereupon the wheels grip the token 401 and cast it toward the vertical target area. Sensors 149 detect if a token 401 passes through the aperture 145, and relates a signal to the CPU if a target has been hit. The CPU then signals to the motor 600 to actuate and release the lever 601, causing a ball 30 to enter the rotating playing field. Once the ball 30 enters the rotating playing field 120, the game continues and operates as described with the first embodiment.

As one skilled in the art will appreciate, there are many modifications and alterations to the just-described embodiments that would be readily apparent to those skilled in the art, and such modifications and alterations are intended to be included within the scope of the invention. Accordingly, the invention should not be construed or limited to those just described embodiments, which are illustrative but not exclusive, but rather the scope of the invention should be determined by the words of the claims appended below using those words common and ordinary meanings within the context of the embodiments described above.

I claim:

1. An arcade amusement machine comprising:

a housing enclosing a processor and a horizontally aligned rotating playing field, said rotating playing field including a vertical target area including a plurality of targets arrayed thereon:

a plurality of sensors each coupled to one of said plurality of targets for sensing when a projectile has hit said one of said plurality of targets, said sensors coupled to said processor to relay to said processor a signal corresponding to a hit target;

a projectile propelling mechanism for launching a projectile at said vertical target area;

a ball positioning mechanism for positioning a ball to enter the rotating playing field;

a plurality of holes on the rotating playing field sized to receive said ball therein through, and further comprising sensors coupled to the processor for signaling to the processor that a ball has passed through a hole having a predetermined point value;

wherein said processor assigns a score for the combination of hitting a target and having a ball enter a particular hole, and display said score.

2. The arcade amusement game of claim 1 wherein said vertical panel includes apertures that may pass a ball therein through to earn a reward, where a sensor positioned adjacent the apertures sends a signal to the processor to multiply a number of tickets distributed by a multiplier associated with said aperture.

3. The arcade amusement game of claim 1 wherein projectile is a token, and the projectile propelling mechanism comprises two counter-rotating wheels through which the token passes to propel the token toward the vertical target area.

4. The arcade amusement game of claim 1 wherein the projectile is a ball, and the projectile mechanism comprises a collapsible bellows positioned outside of said housing, said bellows coupled to a conduit for delivering air from said bellows to a ball cup to launch the ball toward the vertical target area.

5. The arcade amusement game of claim 1 further comprising a ticket dispensing mechanism coupled to said processor for dispensing redemption tickets corresponding to said score.

6. The arcade amusement game of claim 1 wherein the projectile propelling mechanism is aimable at least in an azimuth direction.

7. The arcade amusement game of claim 6 wherein the projectile propelling mechanism is also aimable in an altitude direction.

* * * * *